United States Patent [19]

Uchida

[11] Patent Number: 4,924,204

[45] Date of Patent: May 8, 1990

[54] ORGANIC PTC THERMISTOR DEVICE

[75] Inventor: Katsuyuki Uchida, Ohmihachiman, Japan

[73] Assignee: Murata Manufacturing Co., Ltd., Japan

[21] Appl. No.: 275,101

[22] Filed: Nov. 22, 1988

[30] Foreign Application Priority Data

Nov. 27, 1987 [JP] Japan ..... 62-301218

[51] Int. Cl.[5] ..... H01C 7/10

[52] U.S. Cl. ..... 338/22 R

[58] Field of Search ..... 338/22 R, 225 D; 219/552, 548

[56] References Cited

U.S. PATENT DOCUMENTS 4,414,052 11/1983 Habata et al. ..... 338/22 R X 4,418,272 11/1983 Roller et al. ..... 338/22 R X

*Primary Examiner*—Bruce A. Reynolds

*Assistant Examiner*—Marvin M. Lateef

*Attorney, Agent, or Firm*—Ostrolenk, Faber, Gerb & Soffen

[57] ABSTRACT

An organic PTC thermistor device includes an organic PTC thermistor element having first and second surfaces opposite to each other; first and second electrode layers deposited on the first and second surfaces, respectively, and having defined therein respective non-electrode regions which are displaced in position with respect to each other; and first and second terminal members elastically engaged respectively to a portion of the first electrode layer, which is aligned with the non-electrode region in the second electrode layer and to a portion of the second electrode layer which is aligned with the non-electrode region in the first electrode layer.

3 Claims, 2 Drawing Sheets

ORGANIC PTC THERMISTOR DEVICE

BACKGROUND OF THE INVENTION

1. Field of the Invention

The present invention generally relates to an organic PTC (positive temperature coefficient) thermistor device and, more particularly, to the support of a thermistor element within a casing.

2. Description of the Background Art

Various PTC thermistors have long been used as protective circuit elements for protecting circuit component parts from the overcurrent. Of these various PTC thermistors, organic PTC thermistors are well known and comprise a thermistor element made from electroconductive particles such as, for example, those of carbon black or any other metal, mixed into synthetic resin of a polyolefin system such as, for example, polyethylene.

According to the background art, the thermistor element in an organic PTC thermistor is encased in a fashion shown in FIG. 9 of the accompanying drawings.

Referring to FIG. 9 for the purpose of discussion on the prior art, the organic PTC thermistor element is generally identified by 10 and is in the form of, for example, a disc having on its opposite surfaces respective, thermally-deposited metallic foils. These metallic foils serve as electrodes 11 having respective leads 12 connected thereto by means of solder deposits 13. The assembly is then encased with an outer coating 14 of synthetic resin with outer end portions of the leads 12 exposed to the outside of the outer coating 14 for electric connection with external circuit elements.

In the prior art PTC thermistor device of the construction shown in FIG. 9, it has been found that the thermistor element 10 tends to deteriorate so much as to result in a loss of stability under the influence of heat evolved during the soldering of the leads 12 to the electrodes 11 and/or the formation of the outer coating 14.

In view of the foregoing, the Japanese Laid-open Utility Model Publication No. 61-201, published in 1986, has proposed an organic PTC thermistor device free from thermal influences. According to this publication, the PTC thermistor device comprises an organic PTC thermistor element having electrodes deposited on the respective opposite surfaces thereof, which element is retained in position within a casing by means of a pair of terminal members elastically clamping the element from opposite directions while held in contact with the electrodes.

However, the PTC thermistor device disclosed in the above-mentioned publication has been found having a problem in that, when the thermistor element is heated as a result of an overcurrent induced in the element during its operation, the element, which is made from organic material as its principal component, tends to be softened to such an extent that resilient forces exerted by the terminal members and centered on the respective points of contact with the associated electrodes may cause the element to deform at two locations, corresponding respectively to the points of contact of the terminal members with the electrodes, in respective directions towards each other. In the worst case it may happen, the thickness of the thermistor element may be reduced at a portion where it is elastically clamped by the terminal members, resulting in shortcircuiting between the opposite electrodes.

The above-discussed problem may be obviated if the resilient forces applied from the terminal members to the element through the associated electrodes to retain the element in position are reduced. However, the reduction of the resilient forces may permit the element to undergo arbitrary motion within the casing under the influence of vibrations and/or impacts and also to exhibit an increased contact resistance accompanied by change in operating performance.

SUMMARY OF THE INVENTION

The present invention has been devised with a goal of substantially eliminating the above-discussed problems and, in preferred form, relates to an improved organic PTC thermistor device which comprises an organic PTC thermistor element having first and second surfaces opposite to each other; first and second electrode layers deposited on the first and second surfaces, respectively; said first and second electrode layers having respective non-electrode regions defined therein; said non-electrode regions in the first and second electrode layers being displaced in position with respect to each other; and first and second terminal members elastically engaged respectively to a portion of the first electrode layer, which is aligned with the non-electrode region in the second electrode layer and to a portion of the second electrode layer which is aligned with the non-electrode region in the first electrode layer.

According to the present invention, the first terminal member is elastically engaged to that portion of the first electrode layer which is aligned with the non-electrode region in the second electrode layer, whereas the second terminal member is elastically engaged to that portion of the second electrode layer which is aligned with the non-electrode region in the first electrode layer. The elastic engagement of the respective first and second terminal members to the associated portions of the first and second electrode layers is not only for the purpose of electrically connecting the first and second terminal members with the associated electrode layers, but also for the purpose of supporting the thermistor element.

Because of the unique support system employed in the present invention, even though the thermistor element is softened as a result of self-heating such element will not be deformed substantially because resilient forces of the terminal members are distributed. Should the thermistor element be deformed, shortcircuiting will not occur because a portion of one of the first and second surfaces of the thermistor element that is opposite to that portion of the other of the first and second surfaces in contact with the associated terminal member through the associated electrode layer is deprived of an electrode; that is, aligned with the non-electrode region in the electrode layer on such other of the first and second surfaces. Therefore, in the PTC thermistor according to the present invention, the resilient force applied by each terminal member to the associated surface of the thermistor element through the associated electrode layer can be chosen to be a sufficient value and, accordingly, the thermistor element can be held secure without being adversely affected by external vibrations and/or impacts. The contact resistance between each terminal member and the associated electrode layer can also be stabilized.

BRIEF DESCRIPTION OF THE DRAWINGS

The foregoing and other objects and features of the present invention will become clear from the following description taken in conjunction with preferred embodiments thereof with reference to the accompanying drawings, in which.

DETAILED DESCRIPTION OF THE PREFERRED EMBODIMENTS

Figure 9:
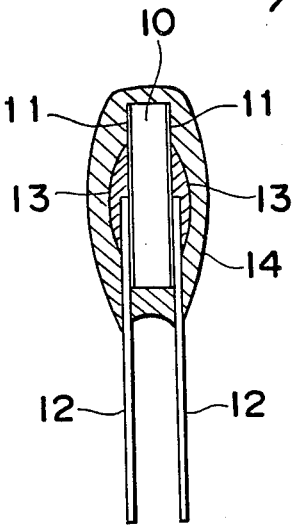
Fig. 9 Prior Art
FIG. 9 is a longitudinal sectional view of a prior art organic PTC thermistor.

Before the description of the present invention proceeds, it is to be noted that like parts are designated by like reference numerals throughout the accompanying drawings except for FIG. 9.

Figure 1:
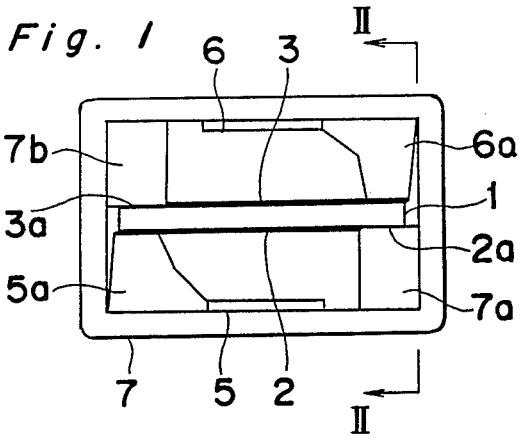
FIG. 1 is an elevational view of an organic PTC thermistor device, with a lid removed, according to a preferred embodiment of the present invention.
Figure 2:
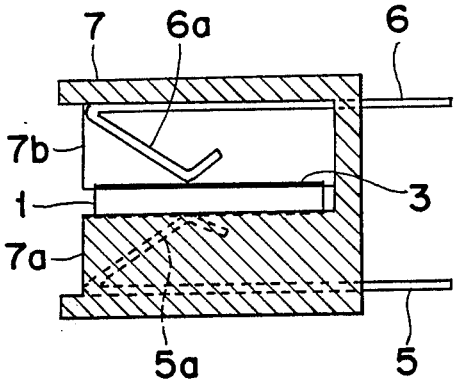
FIG. 2 is a cross-sectional view taken along the line II—II in FIG. 1.
Figure 3:
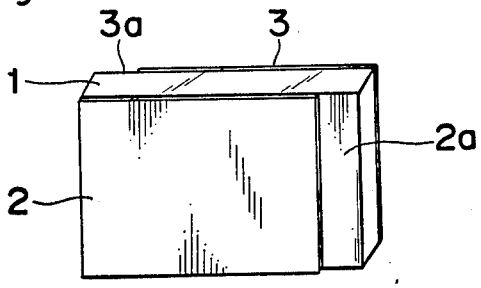
FIG. 3 is a perspective view of an organic PTC thermistor element used in the device of FIG. 1.

Referring first to FIGS. 1 to 3, an organic PTC thermistor device embodying the present invention comprises an organic PTC thermistor element 1 of any known construction made from electroconductive particles such as, for example, those of carbon black or any other metal, mixed into a synthetic resin of a polyolefin system such as, for example, polyethylene. As so far illustrated, the organic PTC thermistor element 1 is generally in the form of a rectangular plate and has opposite first and second surfaces deposited with respective first and second electrode layers 2 and 3. These first and second electrode layers 2 and 3 may be formed by thermally depositing electroaonductive foils, or printing electroconductive paint material, on the respective first and second surfaces of the thermistor element 1. Each of the first and second electrode layers 2 and 3 has a non-electrode or deprived region 2*a* or 3*a* which allows a corresponding portion of the associated surface of the thermistor element 1 to be left uncoated by any electrode material.

In the illustrated embodiment, the first and second electrode layers 2 and 3 have the respective non-electrode regions 2*a* and 3*a* defined therein at such locations that the uncoated portions of the first and second surfaces of the thermistor element 1 can be offset relative to each other in a direction parallel to the longitudinal sense of the thermistor element 1.

The thermistor device also comprises first and second terminal members 5 and 6 each having an inwardly-bent elastic tongue 5*a* or 6*a* and fixed along a corresponding inner wall portion of a casing 7, the elastic tongues 5*a* and 6*a* elastically clamping the thermistor element 1 through the adjacent electrode layers 2 and 3 inwardly from opposite directions to hold and retain the thermistor element 1 in position at a central portion within the casing 7. The terminal members 5 and 6 are so supported by and so positioned in the casing 7 that the elastic tongue 5*a* of the terminal member 5 can be held in engagement with a portion of the first electrode layer 2 on the first surface of the thermistor element 1 which is aligned with the uncoated portion of the second surface for the thermistor element 1. In contrast, the elastic tongue 6*a* of the terminal member 6 can be held in engagement with a portion of the second electrode layer 3 on the second surface of the thermistor element 1 which is aligned with the uncoated portion of the first surface of the thermistor element 1.

At the same time, with the thermistor element 1 positioned inside the casing 7, the respective uncoated portions of the first and second surfaces of the thermistor element 1 are engaged to associated projections 7*a* and 7*b*, integrally formed with the casing so as to protrude inwardly thereof, whereby the resilient forces applied from the elastic tongues 5*a* and 6*a* to the thermistor element 1 can be received by the projections 7*b* and 7*a*, respectively, to secure the thermistor element 1 in position within the casing 7.

Hereinafter, the present invention will be demonstrated by way of some examples which are not intended to limit the scope of the present invention.

Nickel foils were applied to the first and second surfaces of the organic PTC thermistor element 1 and the assembly was subsequently pressed under 120 kg/cm$^2$ for 10 minutes at 190° C. to complete the first and second electrode layers 2 and 3. The organic PTC thermistor element 1 was then cut into some sample chips of 15 mm in length, 10 mm in width and 1.0 mm in thickness, followed by removal of portions of the first and second electrode layers 2 and 3 to form the non-electrode regions 2*a* and 3*a*.

For the purpose of comparison, chips prepared in the same manner as described above, but without the first and second electrode layers 2 and 3 being partially removed, that is, having the first and second electrode layers completely covering the first and second surfaces of the thermistor element, were prepared.

Both of the sample chips according to the present invention and the comparison were elastically sandwiched between the associated elastic tongues within the respective casings.

TEST I

When the resilient force applied from each elastic tongue to the thermistor element was chosen to be 500 g and when a direct current voltage of 30 volts was applied between the terminal members, examination of the thermistor elements according to the illustrated embodiment of the present invention and according to the comparison has revealed that, while no change was found in the thermistor element according to the illustrated embodiment, the thermistor element according to the comparison showed a reduction in thickness of that portion of the thermistor element where the associated elastic tongue is resiliently engaged with a consequent reduction in distance between the first and second electrode layers. In the prior art device, since the points at which the elastic tongues are engaged to the thermistor element from the opposite directions confront with and are aligned with each other, the resilient forces tend to be excessively centered on the terminal members and, therefore, the thermistor element is susceptible to deformation. On the other hand, in the device according to the illustrated embodiment, since the points at which the elastic tongues are engaged to the thermistor element are displaced from each other with the resilient forces distributed, the thermistor element is less susceptible to deformation.

When direct current voltage of 30 volts was continuously applied to the samples according to the illustrated embodiment of the present invention and also according to the comparison, it has been observed that the electrodes in the samples according to the comparison were shortcircuited and burned out after the passage of 200 hours subsequent to the application of the direct current voltage, whereas no change was found in the samples according to the illustrated embodiment of the present invention. It is pointed out that, in the device according to the illustrated embodiment of the present invention, even though the thermistor element undergoes deformation at portions where the elastic tongues are engaged, no shortcircuiting occur because that portion of the thermistor element which is opposite to that portion of the same to which the associated elastic tongue is engaged is occupied by the non-electrode or deprived region in the associated electrode layer.

TEST II

As discussed above, the device according to the comparison is such that, when the resilient force exerted by each terminal member is increased, the thermistor element is susceptible to deformation. Therefore, as tabulated below, a drop test was conducted, with the resilient force reduced in both of Comparisons 1 and 2, to examine any possible change in resistance. During the drop test, two samples for each Comparison 1 and 2 were dropped from a height of 0.75 meters down onto a wooden plate, 30×30 cm in size, made of wood from a maple tree.

| | Resilient Force | Before Test | After Test |
|---|---|---|---|
| Embodiment | 500 g | 0.120 ohm | 0.123 ohm |
| | 500 g | 0.153 ohm | 0.150 ohm |
| Comp. 1 | 100 g | 0.183 ohm | 0.223 ohm |
| | 100 g | 0.153 ohm | 0.187 ohm |
| Comp. 2 | 50 g | 0.220 ohm | 0.198 ohm |
| | 50 g | 0.201 ohm | 0.258 ohm |

As can be understood from the above table, the two samples in each of Comparisons 1 and 2 have shown a considerable change in resistance before and after the drop test. This is illustrative of the fact that, because of insufficient resilient force to hold the thermistor element in position, the thermistor element has undergone arbitrary motion and also a change in contact resistance. In contrast the two samples according to the illustrated embodiment have shown little change in resistance before and after the drop test and, accordingly, the thermistor device according to the present invention is excellent in resistance to vibration and also to impact.

Figure 4:
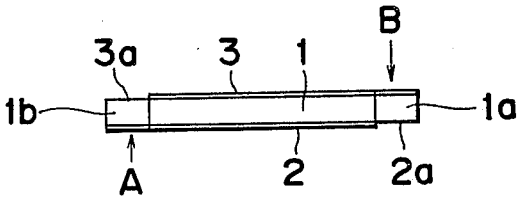
FIG. 4 is an elevational view of a thermistor element according to another preferred embodiment of the present invention.
Figure 5:
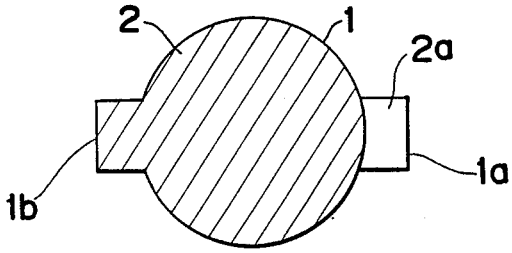
FIG. 5 is a top plan view of the element shown in FIG. 4.

In the embodiment shown in FIGS. 4 and 5, the thermistor element 1 is in the form of a disc having a pair of opposite projections 1*a* and 1*b* protruding radially outwardly therefrom in respective directions away from each other. The first electrode layer 2 is deposited on the first surface of the thermistor element 1 including a continued surface of one of the radial projections, for example, the projection 1*b*, whereas the second electrode layer 3 is deposited on the second surface of the thermistor element 1 including a continued surface of the other of the radial projections, that is, the projection 1*a*. The first electrode layer 2 has the non-electrode or deprived region 2*a* defined therein at a location corresponding to the projection 1*a* while the second electrode layer 2 has the non-electrode or deprived region 3*a* defined therein at a location corresponding to the projection 1*b*. When the thermistor element of the construction according to the embodiment of FIGS. 4 and 5 is mounted and supported within the casing, the resilient forces exerted by the elastic tongues 5*a* and 6*a* (see FIGS. 1 and 2) are applied to a portion of the first electrode layer 2 overlaying the projection 1*b* and a portion of the second electrode layer 3 overlaying the projection 1*a* as shown by the arrows A and B, respectively, in FIG. 4.

Figure 6:
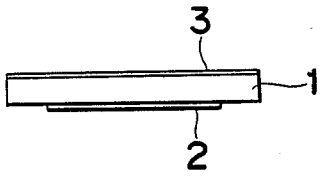
FIG. 6 is a view similar to FIG. 4, showing a thermistor element according to a further preferred embodiment of the present invention.
Figure 7:
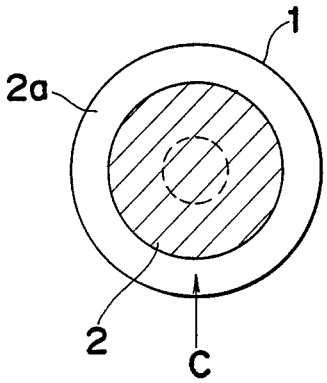
FIGS. 7 and 8 are top plan views of the element of FIG. 6, showing opposite surfaces of the element, respectively.
Figure 8:
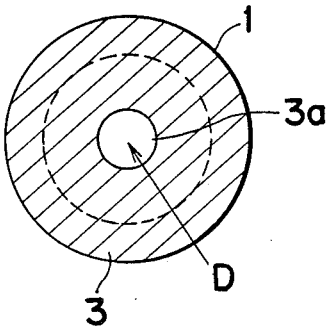

In the embodiment shown in FIGS. 6 to 8, the thermistor element 1 shown therein is similar to that shown in FIGS. 4 and 5 except that no radial projection is employed. The circular thermistor element 1 shown therein has the first electrode layer 2 which is circular in shape and has a diameter smaller than the diameter of the thermistor element 1, so as to leave a non-electrode or deprived region 2*a* corresponding to a peripheral portion of the thermistor element 1 as best shown in FIG. 7. The second surface of the thermistor element 2 is deposited with the second electrode layer 3 which is of a generally-ring shape having an outer diameter equal to the diameter of the thermistor element 1 and having a central portion deprived to provide the non-electrode region 3*a* as best shown in FIG. 8. When the thermistor element of the construction according to the embodiment of FIGS. 6 to 8 is mounted and supported within the casing, the resilient forces exerted by the elastic tongues 5*a* and 6*a* (see FIGS. 1 and 2) are applied to respective points indicated by C and D, respectively, in FIGS. 7 and 8.

From the foregoing description, it has now become clear that the present invention is effective to provide the organic PTC thermistor device which can advantageously withstand not only vibrations and impacts, but also any possible thermal influence which may be brought about during the soldering of the thermistor device to external circuit elements. In addition, any possible deterioration of the thermistor element which will take place when coated with the external coating can also be eliminated.

It is also clear that, since the points at which the terminal members are brought into contact with the thermistor element to retain the latter in position are displaced or offset from each other, there is no substantial possibility that the distance between the electrode layers may be considerably reduced to such an extent as to result in shortcircuiting therebetween. This advantage makes it possible to use terminal members capable of exerting an increased resilient force required to allow the thermistor element to withstand vibrations and/or impacts.

Although the present invention has fully been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims.

I claim:

1. An organic-PCT thermistor device which comprises:

an organic-PCT thermistor element having first and second surfaces opposite to each other;

first and second electrode layers deposited on the first and second surfaces, respectively; said first and second electrode layers having respective non-electrode regions defined therein; said non-electrode regions in the first and second electrode layers being displaced in position with respect to each other; and first and second terminal members elastically engaged respectively to a portion of the first electrode layer that is aligned with the non-electrode region in the second electrode layer, and to a portion of the second electrode layer that is aligned with the non-electrode region in the first electrode layer.

2. The device as claimed in claim 1, wherein the thermistor element is rectangular in shape and wherein the non-electrode region in the first electrode layer is defined at a location corresponding to one of the opposite ends of the thermistor element and the non-electrode region in the second layer is defined at a location corresponding to the other of the opposite ends of the thermistor element.

3. The device as claimed in claim 1, wherein the thermistor element is circular in shape and wherein the non-electrode region in the first electrode layer is defined at a location corresponding to a peripheral portion of the thermistor element and the non-electrode region in the second electrode layer is defined at a location corresponding to a central portion of the thermistor element.

* * * * *